US010660486B2

(12) United States Patent
Osborne, Jr.

(10) Patent No.: US 10,660,486 B2
(45) Date of Patent: May 26, 2020

(54) MONITORING SYSTEM FOR DISPENSER

(71) Applicant: Charles A. Osborne, Jr., Cumming, GA (US)

(72) Inventor: Charles A. Osborne, Jr., Cumming, GA (US)

(73) Assignee: Valve Solutions, Inc., Alpharetta, GA (US)

( * ) Notice: Subject to any disclaimer, the term of this patent is extended or adjusted under 35 U.S.C. 154(b) by 154 days.

(21) Appl. No.: 15/922,157

(22) Filed: Mar. 15, 2018

(65) Prior Publication Data

US 2018/0263435 A1 Sep. 20, 2018

Related U.S. Application Data

(60) Provisional application No. 62/472,866, filed on Mar. 17, 2017.

(51) Int. Cl.
*A47K 10/38* (2006.01)
*B65H 16/00* (2006.01)
(Continued)

(52) U.S. Cl.
CPC ..... *A47K 10/38* (2013.01); *A47K 10/3656* (2013.01); *B65H 16/005* (2013.01);
(Continued)

(58) Field of Classification Search
CPC .. A47K 10/38; A47K 10/3656; B65H 16/005; B65H 16/025; B65H 26/06;
(Continued)

(56) References Cited

U.S. PATENT DOCUMENTS 3,317,150 A 5/1967 Summersby
3,892,368 A 7/1975 Ricards
(Continued)

FOREIGN PATENT DOCUMENTS

WO WO2007/068270 A1 6/2007
WO WO2016/068970 A1 5/2016
(Continued)

OTHER PUBLICATIONS

International Preliminary Report on Patentability and Written Opinion of the International Searching Authority of Internatinal Application No. PCT/US2018/022568 dated Sep. 26, 2019.
(Continued)

*Primary Examiner* — Michael E Gallion
(74) *Attorney, Agent, or Firm* — Womble Bond Dickinson (US) LLP

(57) ABSTRACT

In one aspect, the present disclosure is directed to a sheet material dispenser. The dispenser can include support for supporting a supply of the sheet material, and a feed roller arranged along a feed path of the sheet material downstream from the supply of sheet material that is operable to pull the sheet material from the supply of sheet material for feeding thereof. Additionally, the dispenser can include a controller that is in communication with the feed roller and includes programming for monitoring rotation of the feed roller during a dispensing cycle for feeding a selected length of the sheet material from the supply of sheet material. A material supply monitoring system further can be in communication with the controller, and operative to detect a number of rotations or an angle of rotation of the supply sheet material during at least a series of dispensing cycles.

14 Claims, 11 Drawing Sheets

(51) Int. Cl.

| | |
|---|---|
| ***B65H 16/02*** | (2006.01) |
| ***A47K 10/36*** | (2006.01) |
| ***B65H 26/06*** | (2006.01) |
| ***B65H 35/00*** | (2006.01) |

(52) U.S. Cl.

CPC ..... *B65H 16/025* (2013.01); *B65H 26/06* (2013.01); *B65H 35/006* (2013.01); *B65H 2404/143* (2013.01); *B65H 2511/114* (2013.01); *B65H 2553/51* (2013.01); *B65H 2701/1924* (2013.01)

(58) Field of Classification Search

CPC ..... B65H 35/006; B65H 2404/143; B65H 2511/114; B65H 2553/51; B65H 2701/1924

See application file for complete search history.

(56) References Cited

U.S. PATENT DOCUMENTS 3,893,636 A 7/1975 Wise et al.
4,003,525 A 1/1977 Podvin et al.
4,071,200 A 1/1978 Stone
5,672,206 A 9/1997 Gorman
5,878,381 A * 3/1999 Gemmell ..... A47K 10/36 702/163
6,079,305 A 6/2000 Bloch et al.
6,199,792 B1 3/2001 Mivelaz
6,196,102 B1 6/2001 Granger
6,314,850 B1 11/2001 Morand
6,354,533 B1 3/2002 Jespersen
6,408,727 B1 6/2002 Harris et al.
6,517,025 B1 2/2003 Budz
6,553,879 B2 4/2003 Morand
6,648,267 B2 11/2003 Stanland et al.
6,691,945 B2 2/2004 Slezak
6,830,210 B2 12/2004 Formon et al.
6,834,825 B2 12/2004 Pollastrelli et al.
6,895,296 B2 5/2005 Holt et al.
6,903,654 B2 6/2005 Hansen et al.
6,977,588 B2 12/2005 Schotz et al.
7,040,566 B1 * 5/2006 Rodrian ..... A47K 10/36 242/563
7,114,677 B2 10/2006 Formon et al.
7,191,977 B2 3/2007 Denen et al.
7,213,782 B2 5/2007 Osborne et al.
7,296,765 B2 11/2007 Rodrian
7,370,824 B1 5/2008 Osborne
7,434,760 B2 10/2008 Budz et al.
7,590,467 B2 9/2009 Holt et al.
7,648,098 B2 1/2010 Goeking et al.
7,726,599 B2 6/2010 Lewis et al.
7,783,380 B2 8/2010 York et al.
7,832,678 B2 11/2010 Hjort et al.
7,946,522 B2 5/2011 Lewis et al.
7,967,235 B2 6/2011 Forman et al.
8,082,827 B2 12/2011 Friesen et al.
8,160,742 B2 4/2012 Goerg et al.
8,167,228 B2 5/2012 Kobayashi et al.
8,297,160 B2 10/2012 Friesen et al.
8,353,475 B2 1/2013 Kobayashi et al.
8,382,026 B2 2/2013 Keily et al.
8,402,872 B2 3/2013 Friesen et al.
8,528,851 B2 9/2013 Friesen et al.
8,555,761 B2 10/2013 Keily et al.
8,616,489 B2 12/2013 Goeking et al.
8,651,003 B1 2/2014 Vercellone
8,777,149 B2 7/2014 Goeking et al.
8,800,415 B2 8/2014 Osborne
8,807,475 B2 8/2014 Rodrian et al.
8,833,691 B1 9/2014 Zosimadis
8,919,233 B2 12/2014 Lewis et al.
9,010,602 B2 4/2015 Budz et al.
9,032,850 B2 5/2015 Chiba et al.
9,067,754 B2 6/2015 Petersen et al.
9,604,811 B2 3/2017 Case et al.
9,681,783 B2 6/2017 Goeking et al.
9,756,992 B2 9/2017 Osborne
9,907,441 B2 * 3/2018 Osborne, Jr. ..... A47K 10/38
9,918,597 B2 3/2018 Rubenson et al.
9,944,481 B2 4/2018 Green
9,999,326 B2 * 6/2018 Borke ..... A47K 10/36
2001/0045149 A1 11/2001 Granger
2003/0167893 A1 * 9/2003 Morris ..... A47K 10/36 83/649
2005/0051008 A1 3/2005 Granger
2005/0167541 A1 8/2005 Osborne
2006/0037449 A1 2/2006 Lavallee
2007/0079684 A1 4/2007 Friesen et al.
2007/0176041 A1 8/2007 Friesen et al.
2009/0057478 A1 * 3/2009 Conner ..... A47K 10/36 242/564
2009/0140001 A1 6/2009 Lewis et al.
2009/0256022 A1 10/2009 Maurer
2010/0044407 A1 2/2010 Yardley
2010/0078459 A1 4/2010 Reinsel et al.
2010/0102101 A1 * 4/2010 Keily ..... B26D 1/425 225/10
2010/0243696 A1 9/2010 Friesen et al.
2010/0268381 A1 10/2010 Goerg et al.
2010/0286817 A1 * 11/2010 Goeking ..... A47K 10/3625 700/231
2011/0068129 A1 3/2011 Maurer
2011/0114782 A1 * 5/2011 Rodrian ..... A47K 10/36 242/563
2011/0133019 A1 6/2011 Keily et al.
2011/0148258 A1 * 6/2011 Tanaka ..... H02K 23/66 310/68 B
2011/0233318 A1 9/2011 Anderson
2012/0085857 A1 4/2012 Vienneau et al.
2012/0182366 A1 7/2012 Kobayashi et al.
2012/0312853 A1 12/2012 Osborne et al.
2013/0099924 A1 * 4/2013 Larsson ..... A47K 10/16 340/540
2013/0320130 A1 12/2013 Osborne
2014/0054410 A1 2/2014 Achton
2014/0091168 A1 * 4/2014 Keily ..... A47K 10/34 242/562
2014/0097286 A1 * 4/2014 Francoeur ..... B65H 19/1852 242/431
2014/0263812 A1 9/2014 Osborne
2014/0312158 A1 10/2014 Hlushchenko et al.
2015/0297043 A1 10/2015 Osborne et al.
2015/0327735 A1 11/2015 Himmelmann et al.
2016/0353945 A1 12/2016 Osborne
2016/0353946 A1 12/2016 Osborne
2016/0353947 A1 12/2016 Osborne
2017/0057775 A1 3/2017 Kobs et al.
2017/0188760 A1 7/2017 Henson et al.
2017/0190535 A1 7/2017 Case et al.
2017/0249602 A1 8/2017 Robertson et al.
2017/0254060 A1 * 9/2017 Hall ..... E03D 11/02
2017/0290473 A1 * 10/2017 Borke ..... A47K 10/36
2017/0367547 A1 12/2017 Osborne
2017/0369262 A1 12/2017 Green
2018/0008104 A1 1/2018 Becker et al.
2018/0042431 A1 2/2018 Green et al.
2018/0153360 A1 6/2018 Osborne, Jr. et al.
2018/0177348 A1 * 6/2018 Swanson ..... A47K 10/3687

FOREIGN PATENT DOCUMENTS

WO WO2016/122624 A1 8/2016
WO WO2016/137450 A1 9/2016
WO WO2016/137451 A1 9/2016
WO WO2016/159953 A1 10/2016
WO WO2017/074406 A1 5/2017
WO WO2017/180476 10/2017
WO WO2017/188973 A1 11/2017
WO WO2018/004533 A1 1/2018

(56) References Cited

FOREIGN PATENT DOCUMENTS

| | | |
|---|---|---|
| WO | WO2018/004535 A1 | 1/2018 |
| WO | WO2018/044276 A1 | 3/2018 |

OTHER PUBLICATIONS

International Search Report and Written Opinion for related Application No. PCT/US2018/022568, dated Jun. 7, 2018.

* cited by examiner

MONITORING SYSTEM FOR DISPENSER

CROSS-REFERENCE TO RELATED APPLICATIONS

The present Patent Application claims the benefit of the filing date of previously-filed U.S. Provisional Patent Application Ser. No. 62/472,866 filed on Mar. 17, 2017.

INCORPORATION BY REFERENCE

The specification and drawings of U.S. Provisional Patent Application Ser. No. 62/472,866 filed on Mar. 17, 2017, are specifically incorporated herein by reference as if set forth in their entireties.

TECHNICAL FIELD

The present disclosure is directed to dispensers for flexible sheet materials, and in particular, to a dispenser with a monitoring or sensing system for detection and monitoring of the amounts of sheet material dispensed by the dispenser to enable dynamic measurement of a remaining supply of the sheet material within the dispenser.

BACKGROUND

Dispensers for sheet materials, such as for dispensing towels, tissue or other paper products, are commonly used in hospitals, restrooms and other facilities. When the supply of sheet material in such dispensers is running low or has been fully dispensed, it generally is not apparent until the dispenser is out of and no longer dispenses sheet material. Paper, measuring or metering systems have been used, but generally do not provide precise and/or continuous monitoring of the remaining supply of sheet material. For example, available sheet material metering systems or gauges can include a mechanical lever arm that engages the supply of sheet material and is moved as the sheet material is dispensed and reduces in diameter. After the lever arm has moved a specific distance/amount, i.e., due to a reduction in the diameter of the sheet material, the lever arm will activate a switch that in turn can activate a light or other notification mechanism to indicate a low paper condition. Accordingly, typical paper metering systems often simply provide an indication as to whether the sheet material supply is out or is about to run out, and generally do not provide substantially precise, real-time monitoring of the amount of remaining sheet material. Moreover, after the notification mechanism is activated and the sheet material is continued to be dispensed, the specific amount of sheet material remaining cannot be discerned, e.g., whether the dispenser is completely out of paper or if it still has some amount of sheet material remaining; which may result in replacement of the sheet material before complete dispensing thereof, leading to waste of the sheet material and increasing costs, or the dispenser being rendered inoperable until an empty supply roll is discovered and replaced. The present disclosure addresses these issues and other related and unrelated issues in the art.

SUMMARY

Briefly described, the present disclosure is directed to a dispenser for dispensing sheet materials, such as towels, tissues or other paper products. The dispenser generally includes a housing, with a roll support mounted within the housing and rotatably supporting at least one supply of sheet material at least partially within the dispenser housing. In one embodiment, the dispenser can include, a plurality of supplies of sheet material including, for example, at least one initially full/new roll or primary supply and at least one secondary or "stub roll". The dispenser housing further may include a driven feed roller rotatably mounted therein for feeding the sheet material from each supply roll along a feed or discharge path toward and through a discharge throat arranged along the dispenser housing. The feed roller can be automatically driven, e.g., by a drive system including a motor, or manually driven, e.g., in response to an operator or user engaging a lever or knob or pulling on a portion/tail of the sheet material extending from the discharge throat. The dispenser housing also may include one or more pressing rollers and/or guide rollers arranged along the feed path and adjacent the feed roller to guide the sheet material therebetween and toward the discharge throat.

In addition, the dispenser can include a material supply monitoring and/or measurement system operable to continuously monitor and substantially dynamically determine a remaining amount of the supply of sheet material in the dispenser. In one aspect, the monitoring system can include at least one magnet disposed about the supply which can include a primary supply roll and a secondary or "stub" roll of sheet material, for example, along, or substantially adjacent one end of a core or supporting roll thereof, with the at least one magnet being rotatable therewith during dispensing thereof.

In another aspect, the monitoring system can include a plurality of magnets arranged along, or substantially adjacent to, at least one end of the supply (or supplies) of sheet material (e.g., on a hub or along a portion of the core or support roll for the supply or supplies), defining a magnetic ring. The magnets also may be arranged such that adjacent magnets have opposite polarities, e.g., such that the polarities of the magnets alternate north, south, north, south.

At least one sensor will be arranged substantially proximal or adjacent the at least one magnet or series of magnets, and can include a reed switch, a hall element, proximity sensor, or other suitable sensor operable to measure or otherwise detect variations, fluctuations or other changes in a magnetic field generated as the magnet, or series of magnets, is rotated with the supply of sheet material during dispensing thereof and passes by the sensor. The detected variations, fluctuations or changes of the magnetic field can be correlated to number of rotations of the supply of sheet material and/or a rotation angle of the supply of sheet material for dispensing a desired length of the sheet material during each dispensing operation.

By substantially continuously monitoring the number of rotations of the core of the supply or of sheet material, and the number of rotation of the feed roller or the motor driving the rotation of the feed roller per rotation of the supply of sheet material during a dispensing operation to feed the required or desired length of sheet material as the sheet material is dispensed, a diameter of the supply of sheet material can be substantially dynamically determined during or following each dispensing operation and, based on this determined/monitored diameter, an amount of sheet material remaining in the dispenser can be dynamically determined by the monitoring system with substantial accuracy.

Additionally, other sensing devices or mechanisms, such as encoders or other detectors that can monitor and provide a measurement of the number of rotations of the motor/feed roller and/or extent of rotation of the supply of sheet material can be used, without departing from the scope of the present disclosure.

The dispenser further can include a controller or control system in communication with the at least one sensor of the monitoring system so as to require signals corresponding to the dynamic measurements or readings obtained by the at least one sensor of the monitoring system will be communicated to the controller of the material supply and the feed roller/drive motor, which signals can be indicative of or can be used to determine the number rotations of the supply of sheet material (or the core or support roll thereof) as well as a number of rotations of the feed roller and/or motor driving the feed roller for each rotation of the supply of sheet material, as the sheet material is dispensed. The determined number of rotations of the supply of sheet material and the feed roller/motor further can be used by the controller to calculate or otherwise determine a diameter of the supply of sheet material based, at least in part, on a selected length of sheet material being dispensed by each operation of the dispenser.

As the supply of sheet material is rotated to dispense the selected length of sheet material toward and through the discharge chute by the driving of the feed roller, the number of rotations of the supply of sheet material, or the angular distance of the supply during such rotation needed to dispense the selected length of sheet material during each dispensing operation can be counted and/or updated after each operation to dynamically determine the remaining diameter of the supply of sheet material. This determined remaining diameter of the supply of sheet material can be compared to an initial and/or a final diameter of the sheet material (i.e., a "full" and/or an "empty" supply roll of the sheet material) to determine and update a substantially precise amount of percentage of the sheet material remaining in the dispenser, and/or to a threshold valve to determine a potential need for replacement of the supply of sheet material. Thus, the monitoring system can provide for a substantially continuous, accurate, and precise monitoring of the amount of sheet material remaining in the dispenser, which dynamic or updated measurement further can be reported or communicated to an attendant or to provide notifications of, not only a low paper detection, but also an indication of the amount of paper remaining and/or a projection of when such remaining paper supply might run out.

The monitoring system also can include a means for automatically determining the length of sheet material dispensed during each distribution of sheet material by an operator. In one example, the length of the sheet material dispensed can be determined based, at least in part, on the number of rotations and/or angle of the driven feed roller or its motor. For a feed roller with a specific diameter, a fixed length of sheet material (i.e., 6", 8", 10", 12", etc. . . . ) generally may be dispensed or pulled from the supply with the rotation of the feed roller during a dispensing operation. By monitoring the number and/or the amount of rotations of the feed roller, the controller of the dispenser can determine about how much sheet material is dispensed during a dispensing operation or cycle, as well as when a selected or pre-determined length of sheet material is dispensed during each dispensing operation. The monitoring system also can include one or more sensors that continuously monitor rotation of the motor or the drive shaft driving the feed roller, which sensors can be in communication with and send a signal indicative of the number of rotations of the motor and/or feed roller to the controller. The number of rotations of the motor for feeding a specific length of sheet material thus can be determined and recorded, and further correlated to a substantially precise length of sheet material dispensed which information further can be used for substantially continuously monitoring and updating of the remaining amount of sheet material in the dispenser.

The present disclosure, in another aspect, is directed to a method for substantially continuously monitoring the amount of sheet material remaining in a dispenser. The method may include monitoring rotations, angles, and/or an angular distance of the supply of sheet material as it is dispensed, at intervals or substantially continuously; for example, by measuring or otherwise detecting the presence, fluctuations or variations of a magnetic field due to at least one magnet rotating with the supply of sheet material during dispensing and passing by one or more sensors arranged substantially adjacent the supply in a position(s) or location to detect/sense the at least one magnet as the supply is rotated. In addition, the rotation of the motor and/or feed roller also will be monitored for determining a number of rotations of the motor or feed roller per rotation of the supply of sheet material. The detected number of rotations of the feed roller and/or the motor driving the feed roller per rotation of the supply of sheet material during each dispensing cycle or operation can be correlated with a changing diameter of the supply of sheet material from the dispensing the specific or prescribed length of sheet material. The method further can include continuously monitoring when the selected or specified length of sheet material is dispensed, for example, by monitoring the number of rotations of the feed roller or the motor of the feed roll mechanism during each operation for a length of sheet material dispensed, to substantially continuously determine when the specific length of sheet material dispensed and/or how much material is dispensed.

The diameter of the supply of sheet material thus can be substantially dynamically determined upon each dispensing operation by monitoring and detecting the number of rotations of the supply of sheet material required to dispense the determined or selected length of sheet material and the feed roller and/or motor driving the feed roller per rotation of the supply of sheet material during such a dispensing operation, and the changes in this detected number of rotations after each dispensing operation, or after a selected series of dispensing operations. This information further can be compared to an initial and/or a final diameter of the sheet material to provide a running count or monitored amount of sheet material remaining in the supply of sheet material in the dispenser. The controller additionally can provide updates of this remaining diameter to notify personnel of a low supply condition and/or the remaining supply amount in the dispenser.

Those skilled in the art will appreciate the above stated advantages and other advantages and benefits of various additional embodiments by reading the following detailed description of the embodiments with reference to the below listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION

Figure 1A:
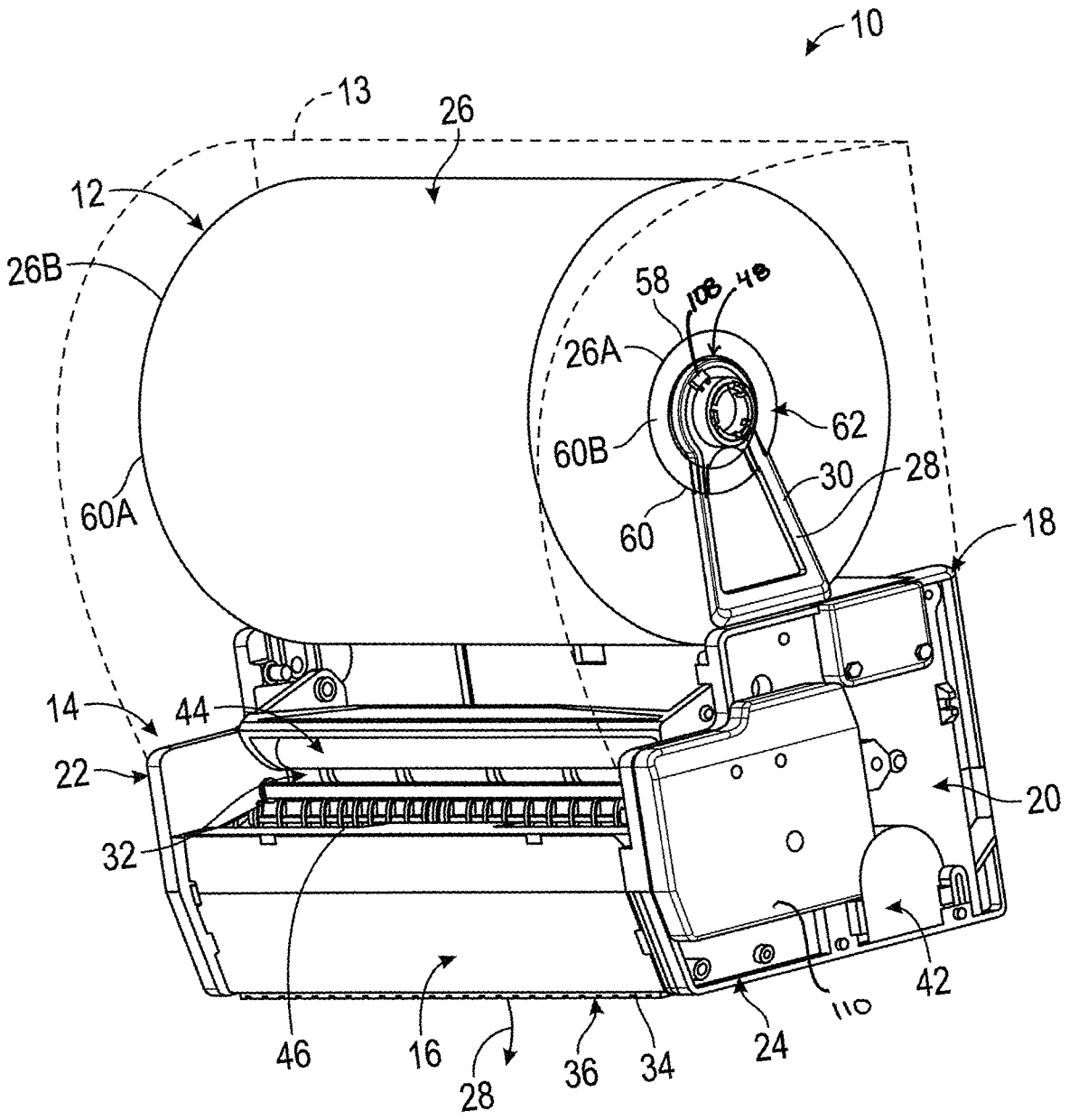
FIGS. 1A-D show a dispenser according to one aspect of this disclosure.

FIGS. 1A-D, 2A-B, and 3A-B show a dispenser 10 for a sheet material having a material supply monitoring and/or measurement system 100 for continuously, accurately, and precisely monitoring a remaining amount of sheet material in the dispenser 10. As shown in FIGS. 1A-D, an example dispenser 10 for sheet material 12, such as tissue, paper products and/or other suitable materials, will include a dispenser housing 14 having a cover 13, a front 16, rear 18, side 20/22, and bottom 24 sides or portions. The dispenser 10 further includes at least one supply 26 of sheet material, such as a roll of paper at least partially supported along the dispenser housing 14. For example, the dispenser 10 can include one or more supports 28 that can engage a core or center support roll 58 of the supply so as to rotatably support the supply 26 of sheet material along, or at least partially within, the dispenser housing 14. The dispenser 10 further can include at least one additional supply 27 (FIGS. 1B, 1D, 2A) of sheet material having a core or center support roll 58 that is rotatably mounted to one or more additional supports 29. In one embodiment, the first supply of sheet material 26 can be a full or new roll of sheet material and the second supply 27 can be a "stub roll" that includes a roll and sheet material that has been at least partially dispensed, and can serve as a backup supply if the primary supply 26 runs out. For example, a full/new roll could be loaded into supports 28 and when the full roll has been substantially dispensed, e.g., more than 50% of the supply has been dispensed, the partially dispensed roll (e.g., a "stub roll") can be moved to another position within the dispenser and can be supported by the additional supports 61 from which the "stub roll" can be fully dispensed.

In one example embodiment, as shown in FIGS. 1A-D and 2A-B, the supports 28 can include one or more arms 30 that are connected to the dispenser housing 14, such as at sides 20/22, and that can be biased into engagement with and/or rotatably coupled to the ends 26A/B of the supply 26 of sheet material or the core 58 thereof, so that the supply 26 of sheet material is enabled to substantially freely rotate with respect to the arms 30 as the sheet material is pulled from the supply during dispensing of the sheet material. The supply 26 of sheet material may be otherwise rotatably mounted to, or along, the dispenser housing 14, without departing from the present disclosure. For example, the ends 26A/B of the supply 26 of sheet material may be at least partially received within grooves defined in a portion of the dispenser housing 14, e.g., sides 20/22, or can be directly connected to at least a portion of the dispenser housing 14, such as by one or more bearings or other suitable connection mechanisms for rotatably mounting the supply 26 of sheet material.

The additional supports 29 (FIGS. 1B, 1D) can include one or more arms 31 that are connected to the dispenser housing 14, such as at sides 20/22, and that can be biased into engagement with and/or rotatably coupled to the ends 27A/B of the supply 27 of sheet material or the core 58 thereof, so that the supply 27 of sheet material is enabled to substantially freely rotate with respect to the arms 31 as the sheet material is pulled from the supply during dispensing of the sheet material. The supply 27 of sheet material may be otherwise rotatably mounted to, or along, the dispenser housing 14, without departing from the present disclosure. For example, the ends 27A/B of the supply 27 of sheet material can be directly connected to at least a portion of the dispenser housing 14, such as by one or more bearings, bushings, etc., or other suitable connection mechanisms for rotatably mounting the supply 27 of sheet material.

Figure 1B:
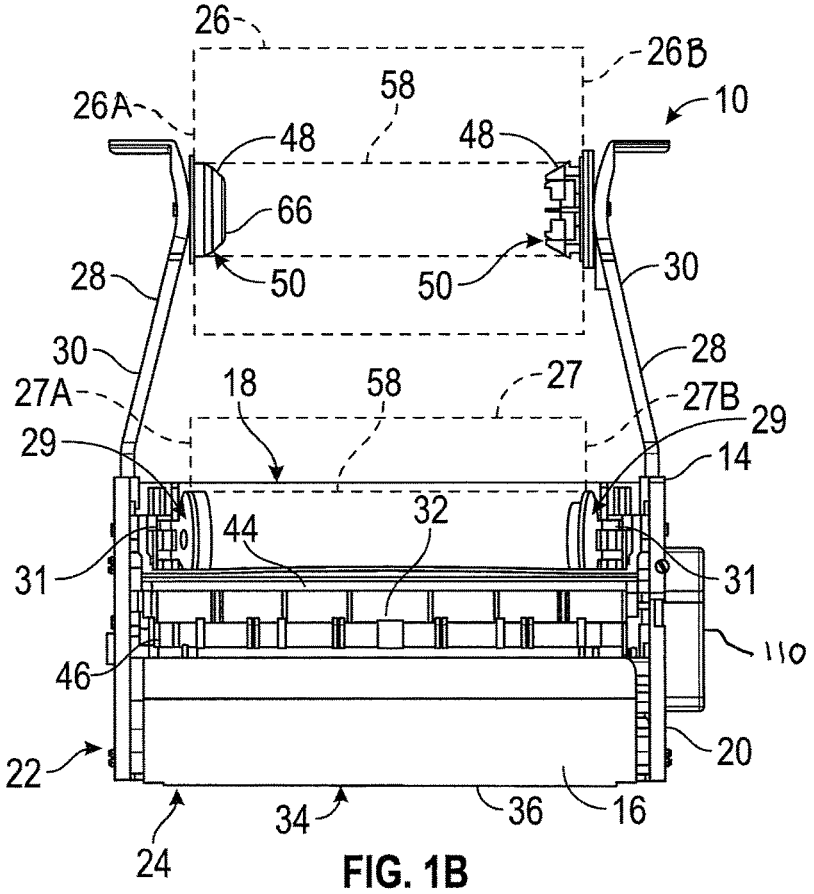
Figure 1C:
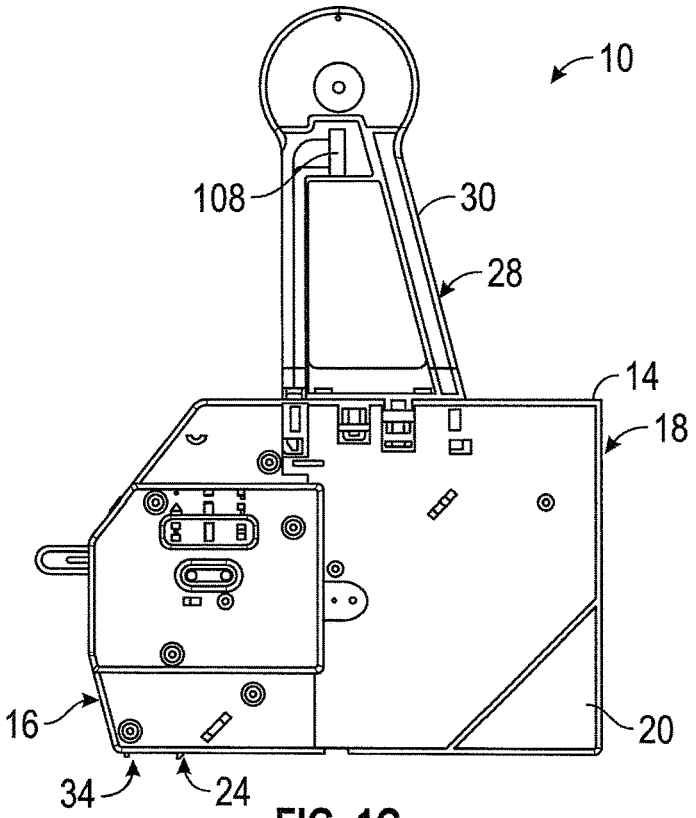
Figure 1D:
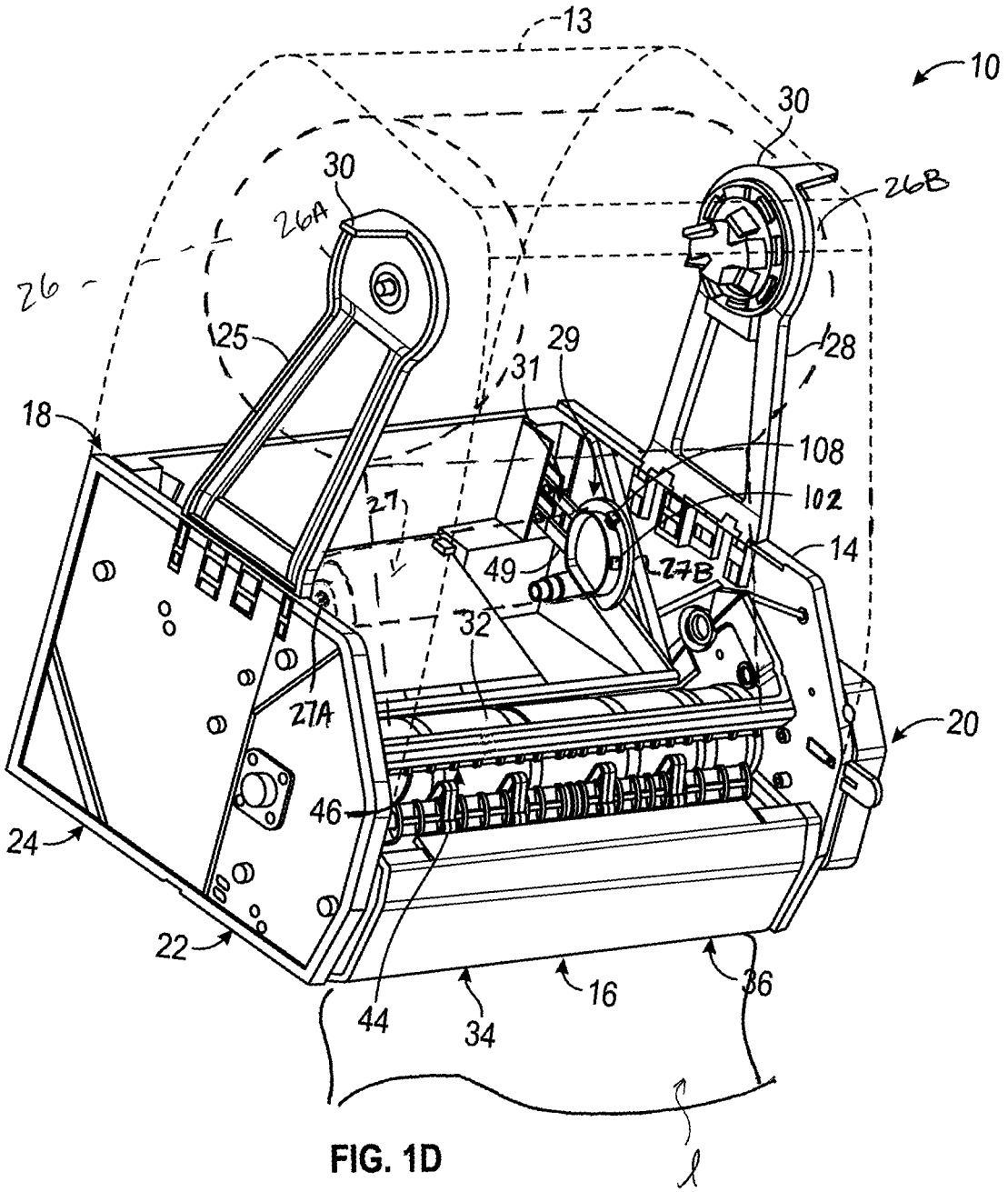

Additionally, as shown in FIGS. 1A-B and 1D, the dispenser 10 further generally will include a feed roller 32 rotatably mounted therein. The feed roller 32 will be operable to rotate/pull and guide/feed the sheet material 12 along a feed or discharge path 28 towards a discharge chute 34 of the dispenser for dispensing or distribution of a length of the sheet material to a user. The discharge chute 34 can comprise an opening or slot 36 arranged along the bottom portion 24 of the dispenser housing 14. A portion of the sheet material 12 will be at least partially disposed about and in engagement or contact with the feed roller 32, such that, upon rotation of the feed roller the sheet material will be pulled, causing the supply 26 of sheet material to be rotated and an amount or length of sheet material 12 to thus be fed to and through the discharge chute 34. The feed roller 32 can have a diameter selected for feeding a prescribed or predetermined or known length or amount of sheet material. For example, the feed roll 32 can have a diameter or size selected to feed an 8", 10", 12" or other predetermined length of sheet material for each revolution or pre-set series of revolution per dispensing operation.

In one example, the feed roller 30 can be manually driven, e.g., when an operator actuates a knob or lever or pulls or tensions a portion of sheet material 12 extending from the discharge chute 36 (not shown). Additionally, or in the alternative, the feed roller 32 can be automatically driven by a drive mechanism 38 (shown in FIG. 4) that activates when one or more sensors detect a predetermined condition, for example, when a proximity sensor 33, such as an infrared sensor, detects the presence of a user's hand adjacent or below the dispenser housing 14, or detects the absence of sheet material extending from the discharge chute 34. The one or more sensors also can include a switch or lever, e.g., flapper or pawl member 70, arranged along a tear bar 47 or other cutting mechanism that is activated when a user tears away a select amount of sheet material.

The drive mechanism 38 of the feed roller generally can comprise a motor 40, such as a DC motor (e.g., brush or brushless DC motor), an AC motor, stepper motor, servo motor or other similar motor or actuator. The motor 40 can be powered by a battery pack 42 or other power source arranged at least partially within or along the dispenser housing 14. As indicated in FIGS. 2B-3A, the drive mechanism 38 also can be integrated with the feed roller 32, or can be arranged separately from the feed roller 32 and can be in communication therewith and/or drive the feed roller through one or more gear assemblies 39, though other transmissions mechanisms, devices, assemblies, etc., such as one or more pulley assemblies, can be used without departing from the scope of the present disclosure. U.S. patent application Ser. No. 15/173,970, which is incorporated by reference herein in its entirety, shows example arrangements of integrated and other drive mechanisms. Any suitable arrangement or configuration for the drive mechanism can be employed, however, without departing from the scope of the present disclosure.

Figure 2A:
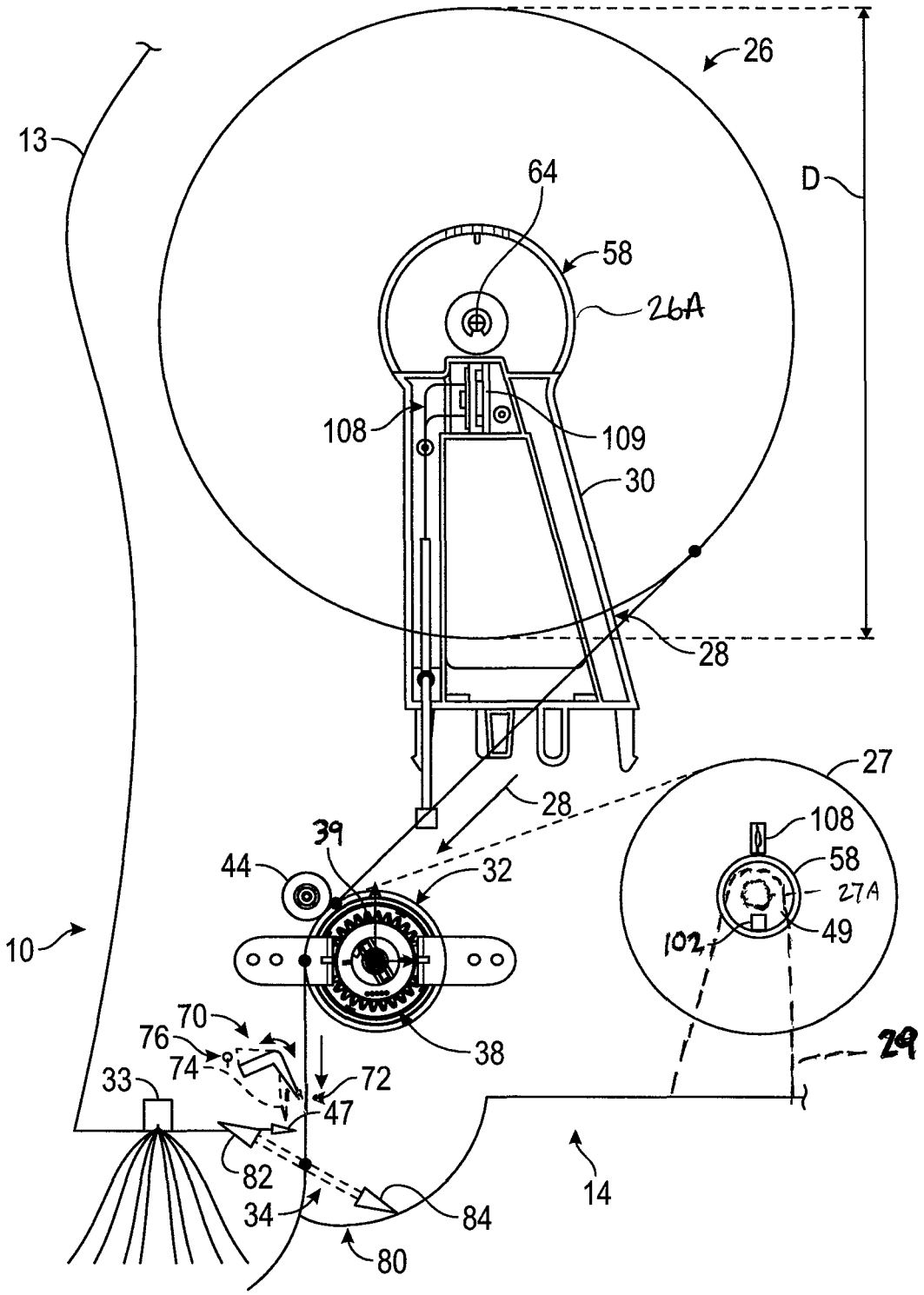
FIG. 2A is a perspective view schematically illustrating a roll support and feed roller for feeding sheet material from a supply of sheet material in the dispenser of FIGS. 1A-D.
Figure 3A:
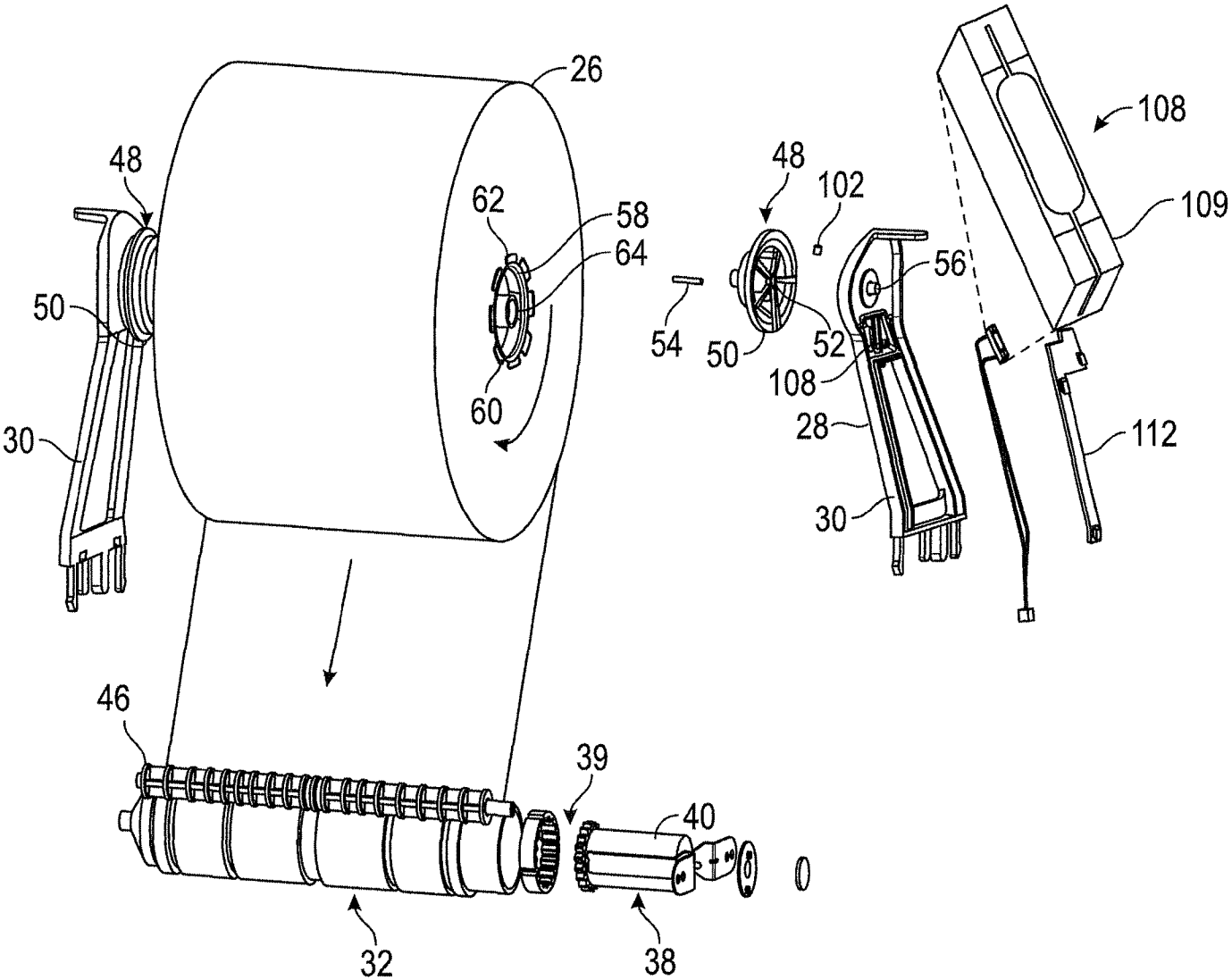
FIG. 3A is an exploded schematic view of the material supply monitoring and/or measurement system according to the principles of the present disclosure.

FIGS. 1A-B, 1D and 3A further show that the dispenser 10 can include one or more guide or pressing rollers 44/46 rotatably mounted along the feed path 28 of the sheet material, adjacent the feed roller 32, in positions so as to contact and/or functionally engage and guide the sheet material 12 therebetween as the sheet material is fed along the discharge path 28 for dispensing thereof. The guide rollers 44/46 can be biased toward the feed roller 32, such as by one or more springs or other suitable biasing members to contact and engage the sheet material between each guide roller and the feed roller; however, one or more of the guide rollers can be fixed, i.e., unbiased, without departing from the present disclosure. Additionally, although a pair of pressing rollers 44/46 can be used as indicated in FIGS. 1A-B, any number, arrangement, and/or configuration of biased or unbiased guide rollers, such as one, three, or four guide rollers also can be employed without departing from the present disclosure, e.g. as indicated in FIGS. 2A and 3A the dispenser 10 further can include one or more cutting mechanisms as such as a blade or tear bar 47 (FIG. 2A), configured to cut, perforate, tear or otherwise sever the sheet material. In one example, a cutting mechanism can be disposed along the feed roller 32 and can be movable therewith to cut or perforate the sheet material 12 as it is dispensed. Additionally, or in the alternative, the cutting mechanism can include a tear bar 47, with a jagged or serrated edge, that is arranged along or adjacent the discharge chute 34 of the dispenser to allow a user to tear off a desired amount or length of sheet material 12 after it is dispensed.

Figure 2B:
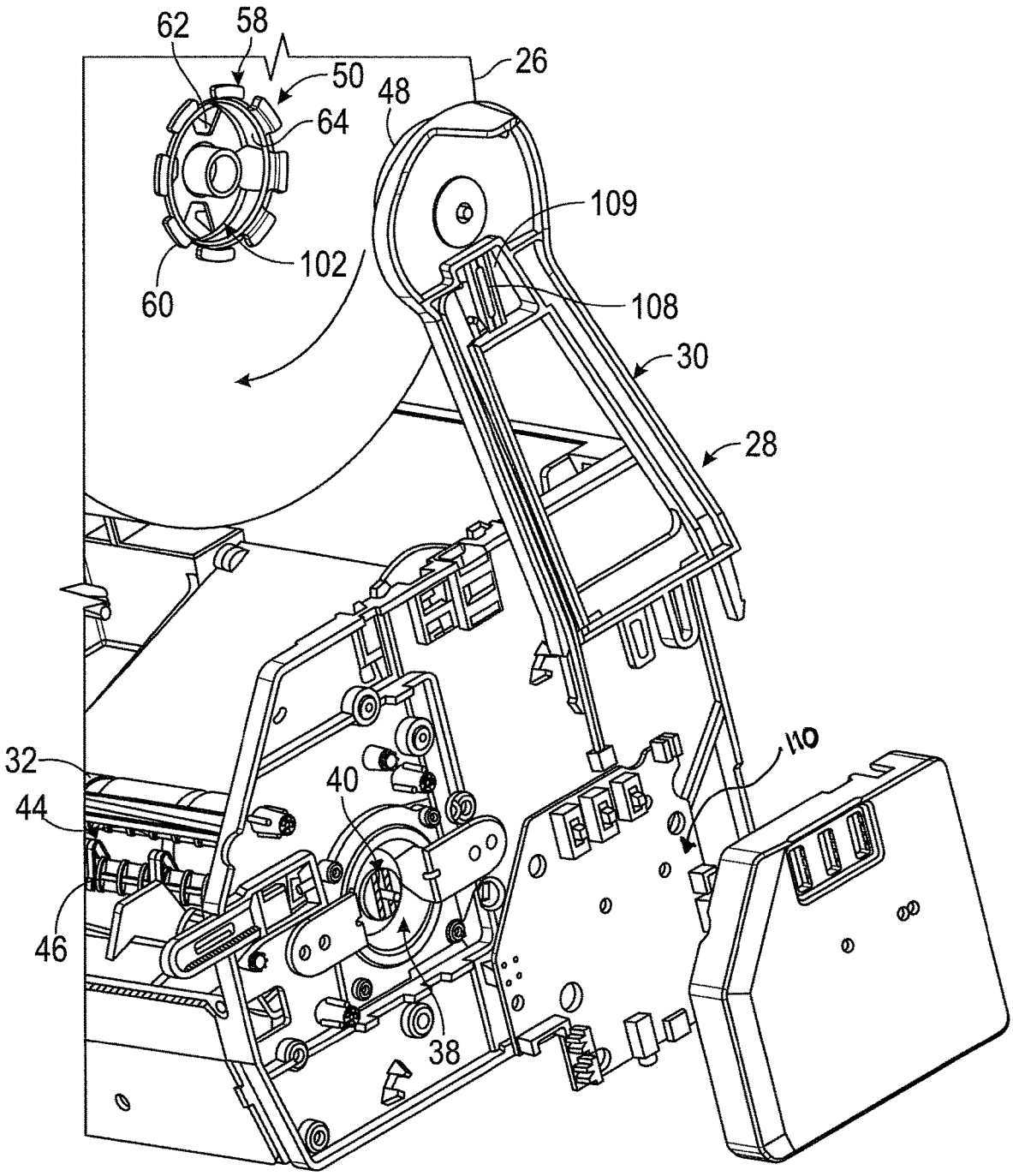
FIG. 2B is an exploded view of the dispenser of FIGS. 1A-1D showing one aspect of the material supply monitoring and/or measurement system according to the principles of the present disclosure.

As shown in FIGS. 1A-D and 2A-B, the supply/supplies 26 and 27 of sheet material will be rotatably coupled to the supports 30 and additional supports 31, respectively. For example, as shown in FIGS. 1B and 2B, the supports 30/31 generally include or are coupled to connecting members or to hubs 48/49 at each end of the supply or other suitable attachment mechanism operable and/or configured to be connected to the ends 26A/B or 27A/B of the supplies 26/27 of sheet material, such that the supplies 26/27 of sheet material are rotatable therewith. For example, hubs 48 can include a hub body 50 that is rotatably engaged with or coupled to a corresponding support arm 30. FIG. 2B shows that each hub body 50 can have a substantially circular or disk-like shape, though any suitable shape, such as a semi-spherical or polygonal shape, can be employed without departing from the present disclosure. Each hub body 50 also can have a hole or opening 52 defined therethrough and configured to receive a pin 54 or other suitable mechanism that further can be received through a corresponding hole or opening 56 in an associated or adjacent arm 30 to rotatably couple each hub body 50 to its arm 30, as shown in FIG. 3A. The pin 54 can be secured in place by a clip or locking ring 57 or other suitable attachment mechanism (FIG. 3A). The secondary supply or stub roll 27 can be similarly rotatably supported from its support 59.

Additionally, each of the supplies 26/27 of sheet material can include a rigid supply roller or core 58 around which the sheet material 12 is rolled or otherwise disposed. Each supply roller 58 generally can include a cylindrical body 60 with a cavity 62 defined therein and an opening 64 at each of its ends 60A/B (FIGS. 1A, 2B, and 3A), shaped, sized, dimensioned or otherwise configured such that at least a portion of the hub body 50 of each hub is at least partially received within a corresponding opening 64 at each end 60A/B of the supply roller body 60. For example, as shown in FIGS. 1B and 2B, the hub body 50 can include a frustoconical, conical, or otherwise angled portion 66 that fits into an opening 60A/B and projects at least partially into the internal cavity 62 of the supply roller body 60, e.g., in frictional engagement therewith, such that the core 58 of the sheet material supply and thus the supply of sheet material are rotatable. Each hub body 50 further can include one or more stoppers, tabs or other suitable projecting portions 68 that are sized, dimensioned, or configured to engage at least a portion of the supply roller body 60 to prevent slippage between the hub bodies 50 and supply roller or core 58 during dispensing of the sheet material.

As further shown in FIG. 2A, the proximity sensor 33 for detecting the presence of a user's hand or other suitable portion of a user's body or object can be disposed along the dispenser housing 14. The sensor 33 will be positioned so as to detect the presence of a user's hand or other portion within an area or proximity below the dispenser housing 14, and will send a signal to a controller 110, in response to which operation of the dispenser can be activated to dispense a measured/select amount of sheet material.

FIG. 2A additionally shows that the dispenser 10 can include a pivotally mounted lever, flapper or pawl member 70 generally located proximate to the tear bar 47. In one embodiment, the flapper member 70 is positioned such that movement of sheet material into the tear bar 47 for severance thereof causes the sheet material to at least partially engage and pivot or otherwise move the flapper member 70 from a first position 72 to a second position 74. In addition, a signal means 76 can be in communication with the flapper member 70 such that movement of the flapper member 70 to its second position 74 can cause the signal means 76 to transmit or otherwise send a signal, e.g., to notify or indicate to the controller or control system 110 of the dispenser, that the sheet material 10 has been removed or at least pulled or otherwise engaged against the tear bar 47.

In addition, that the dispenser 10 can include a sheet material detection sensor 80 operable to detect sheet material 10 in and along the discharge chute 34. In one embodiment, the sheet material detection sensor 80 can include at least one signal emitter and at least one signal detector 82/84 (e.g., at least one IR signal emitter and at least one IR detector) disposed along opposing portions of the discharge chute 34. The emitter and detector will be focused or directed across at least a portion of the discharge path, such that when sheet material is present in the discharge chute/path, the detector will not receive a signal from the emitter, i.e., the signal will be blocked, indicating the presence of the sheet material in the discharge chute, while the location of the sensor 80 also substantially avoids inadvertent detection of a user's hand.

The proximity sensor 33, the flapper or pawl member 70, and the sheet material detection sensor 80 can include any suitable components, have any suitable construction, and/or perform any suitable functions or operations, without departing from the scope of the present disclosure, for example, as detailed in U.S. patent application Ser. Nos. 13/155,528 and 15/173,970, the disclosures of which are incorporated by reference herein as if set forth in their entireties.

The dispenser 10 additionally includes a sheet material monitoring and/or monitoring system 100 generally shown in FIGS. 2A-3B, and operable to substantially continuously measure the feeding of lengths of the sheet material during each operation of the dispenser for dynamically determining and tracking the amount of remaining sheet material 12 of the supplies 26/27 of sheet material with enhanced precision and accuracy as the sheet material continues to be dispensed from the dispenser. In one example, the monitoring system 100 can include at least one magnet 102 disposed along the supply 26 and/or the supply 27, for example, attached along at least one end, e.g., ends 26A or 26B, thereof, such that the at least one magnet 102 is rotatable with the supply 26 and/or 27 during a dispensing operation.

Figure 3B:
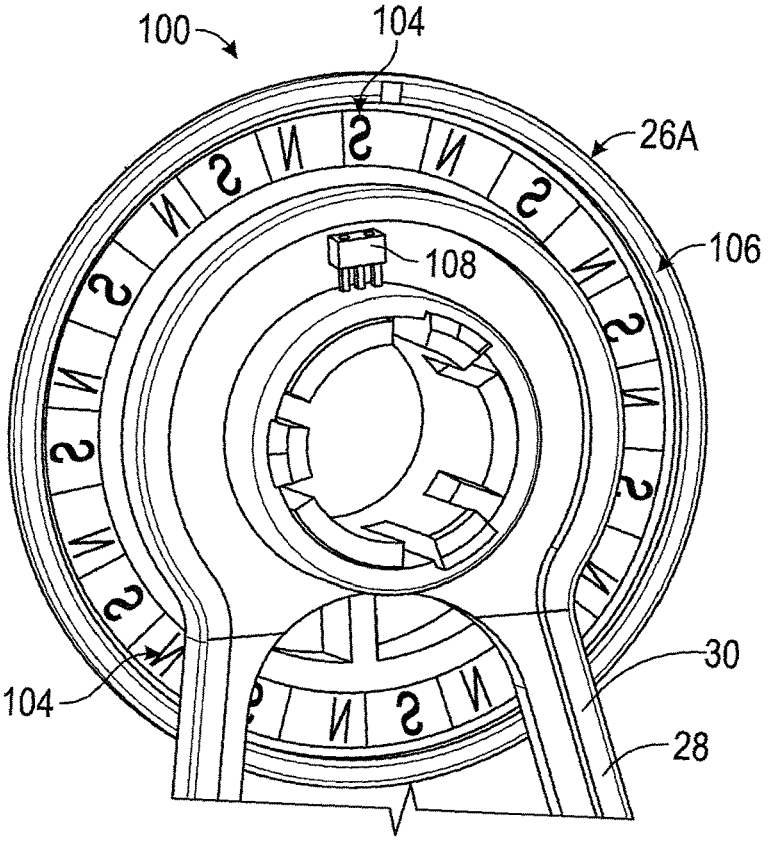
FIG. 3B is a side view of an example sensor arrangement for the material supply monitoring and/or measurement system.

Alternatively, the monitoring system 100 can include a plurality of magnets 104, e.g., arranged about one of the ends of the supply 26 and/or the supply 27, and rotatable therewith, which plurality of magnets 104 can be arranged to form a magnetic ring 106 with adjacent magnets having opposite and alternating polarities, for example, the magnets arranged with alternating polarities, i.e., north, south, north, south and so on (FIG. 3B). The magnet 102 or the plurality of magnets 104 can include rare-earth magnets, electro magnets, and/or otherwise magnetized materials.

As further shown in FIGS. 1D, 3A, and 3B, the magnet 102 or magnetic ring 106 of magnets 104 can be mounted to or arranged about a hub 48 or 49 of at least one of the support arms 30 or 31 and to which an end of the core of the supply 26 or 27 of sheet material is mounted so as to be rotatably supported by the support arms.

The present disclosure is not limited to a specific configuration and/or arrangement of magnet(s), however, and the magnet or plurality of magnets can be mounted along or connected to the supply/supplies of sheet material, such as by being directly connected to or formed with the supply roller or core 58 for the supply/supplies of sheet material or otherwise connected thereto, such that the magnet or magnets rotate with the rotation of the supply of sheet material during a dispensing operation, as generally shown in FIG. 2B.

The monitoring system 100 also will include at least one sensor 108, for example, a reed switch, a hall element, proximity sensor, or other suitable sensing mechanism or device operable to measure or detect the presence of a magnet and/or fluctuations or variations in a magnetic field. The at least one sensor 108 can be arranged or positioned within or along the dispenser housing typically being located substantially adjacent the at least one magnet 102 or plurality of magnets 104, in a position to detect the presence of the magnet(s) and/or measure or otherwise detect fluctuations or variations in the magnetic field created as the magnet or the plurality of magnets is rotated or otherwise moves past the sensor with the rotation of the supply 26 of sheet material during a dispensing operation. For example, the sensor 108 can be arranged along an arm 30 substantially adjacent or proximal to the rotating hub 48 to which the magnet or ring of magnets is mounted, such as shown in FIG. 3A. The sensor 108 further can be received within a cavity or chamber 109 defined in the arm 30 and can be secured, such as by a snap fitting, fastener or other suitable connection mechanism. The chamber 109 may be at least partially enclosed by a cover 112 or other portion that can be removably attached to the arm 30. Other sensors, detecting mechanisms, etc., such as an encoder or other detector capable of monitoring and determining the rotation of the sheet material supply also can be used.

As indicated in FIG. 2A, a similar sensor 108 further can be arranged along the dispenser housing substantially proximate or adjacent to the supports 59 for the second ("stub") roll 27. This sensor 108 can be located and configured to function in a substantially similar manner as the sensor 108 monitoring rotation of the main or primary supply 26. However, it will also be understood that the magnet 102 and sensor 108 for the second (stub) roll 27 do not have to be used as it is not necessary or required that the dispenser include a second or stub roll; that the monitoring system monitor the second (stub) roll or to do so in the same manner as the supply 26. Moreover, it will be understood that the sheet material of the second supply roll 27 generally can be maintained out of engagement with the feed roller until the main or primary supply 26 has been substantially exhausted, or the supply is detected as having a selected minimum amount remaining sufficient to trigger feeding of sheet material from the second supply roll.

The detection of the magnet(s) passing by, or fluctuations, variations and/or changes in the magnetic field being detected by the sensor 108 can be correlated with an angle, an annular distance and/or a number of rotations (including partial rotations) of the supply 26 of sheet material as the sheet material is dispensed. For example, the number of times the magnet is detected by the sensor or the changes in polarities detected as the ring of magnets is rotated can be counted and empirically correlated to a specific number of rotations or an amount or distance of rotation of a supply 26/27 of the sheet material, e.g., during one dispensing operation, 2 rotations may be detected for feeding 10" of sheet material, while 2.1, 2.3 or 2.5 rotations may be detected during subsequent dispensing operations for feeding a 10" length of the sheet material. Furthermore, based at least in part on a known, predetermined length of the sheet material being dispensed by the revolution of the feed roller during a dispensing cycle or operation, radian measurements can be used to determine a substantially precise diameter of the sheet material remaining on the supply roll based on the number of rotations of the supply roll detected/measured by the sensor 108.

Figure 5:
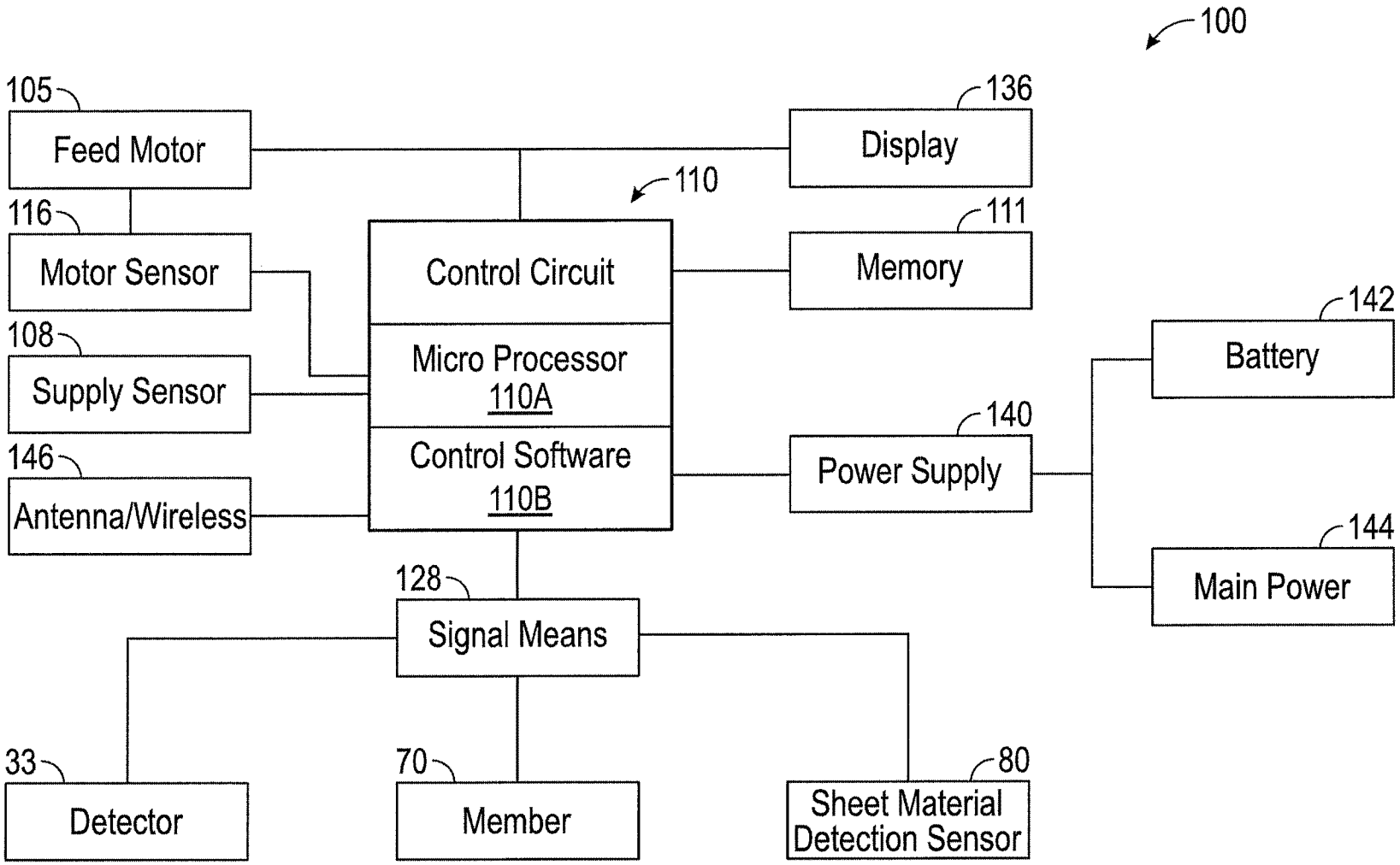
FIG. 5 illustrates a controller or control system for the dispenser according to the principles of the present disclosure.

In one example, the monitoring system 100 may communicate signals indicative of the number of rotations of the supplies 26/27 of sheet material operating and being measured by the sensor 108 during a dispenser operation or cycle to a controller or control system 110 (FIG. 5) of the dispenser 10 such as by a wired or wireless connection. FIG. 5 generally illustrates an example controller or control system 110 for the dispenser, which can comprise a processor 110A, programming or control software 110B, including programming, instructions, workflows, etc. for facilitating operation of the monitoring system. The controller 110 further can communicate with a signal means 128, including the hand or proximity detector 33, the pawl or flapper bar member 70, and the sheet material detection sensor 80; and in response to signals therefrom, control operation of the feed roller motor and/or provide output signals a display 136. A power supply 140, which can include a battery 142 or AC power connection 144 also generally will be connected to the controller for powering the operation of the dispenser. Further examples of control systems are shown in U.S. patent application Ser. Nos. 15/173,970 and 15/185,776, which are incorporated by reference herein as if set forth in their entireties.

The controller receives inputs from the supply roll sensor 108 as to the number of rotations thereof, and from a motor sensor or detector assembly 116 that monitors and detects rotations of the motor and/or the feed roller; and in response, the dispenser controller 110 can use this measured information to calculate a remaining diameter of the supply of the sheet material following completion of each dispensing operation or cycle, or at least selected ones of the dispensing cycles. This calculated/updated remaining diameter or amount further can be compared to an initial and/or a final diameter of the sheet material to determine a substantially precise percentage of sheet material remaining in the dispenser. Thus, the monitoring system 100 can provide for substantially precise, continuous, and updated monitoring of the amount of sheet material remaining in the dispenser. As an alternative, for example, in a manually operated dispenser or as a retro-fit application, the monitoring system can include or be integrated with its own controller that dynamically determines the changes in the remaining amount of the supply of sheet material.

The controller further can receive inputs from the sensor 108 (or sensors) to verify that sheet material was actually dispensed from one of the supplies 26/27. For example, operators often may just dispose of (i.e., throw away) partially dispensed ("stub") rolls as opposed to moving the rolls to the additional support 29 for fully dispensing the sheet material/paper therefrom, which can waste a considerable amount of sheet material. Accordingly, the sensor 108 dispensed adjacent to the support 29 can send a signal to verify that the second ("stub") roll has been loaded for dispensing, as well as the number of rotations thereof for determining an amount of sheet material remaining on this roll.

The monitoring system 100 additionally can include a means for automatically determining the length of sheet material dispensed during each distribution of sheet material by an operator. In one example, the length of the sheet material dispensed can be determined, based at least in part, on a programmed or known number of rotations of the motor 40 and/or the feed roller 32. Specifically, the feed roller 32 can have a specific diameter selected for feeding a substantially fixed or known length of sheet material with each rotation thereof. Thus, monitoring the number of rotations of the feed roller 32 and/or its motor enables the controller to determine completion of each dispensing cycle and also can allow for a substantially more precise determination of the length of sheet material dispensed during each cycle including cycles or operations that may have been prematurely halted, such as by a user pulling/tearing the paper before the motor has fed a full sheet length. Additionally, or in the alternative, the number of rotations of the motor 40 or a drive shaft 41 thereof for each rotation of the feed roller 32 can be determined, for example, based on a specific pulley or gear ratio between the motor 40 and the feed roller 32, and a unit length of sheet material dispensed can be determined based upon the number of rotations of the motor 40 or its drive shaft.

The correlation of the number of rotations of the motor 40 and/or feed roller for each unit length of sheet material will be communicated to the controller 110 and be used to determine a specific length of sheet material that has been dispensed, and/or when a specified length of the sheet material (e.g., 10", 12", etc . . . ), has been dispensed, and a dispensing operation completed, by monitoring the operation of the motor 40 and/or rotation of the feed roller 32.

Figure 4:
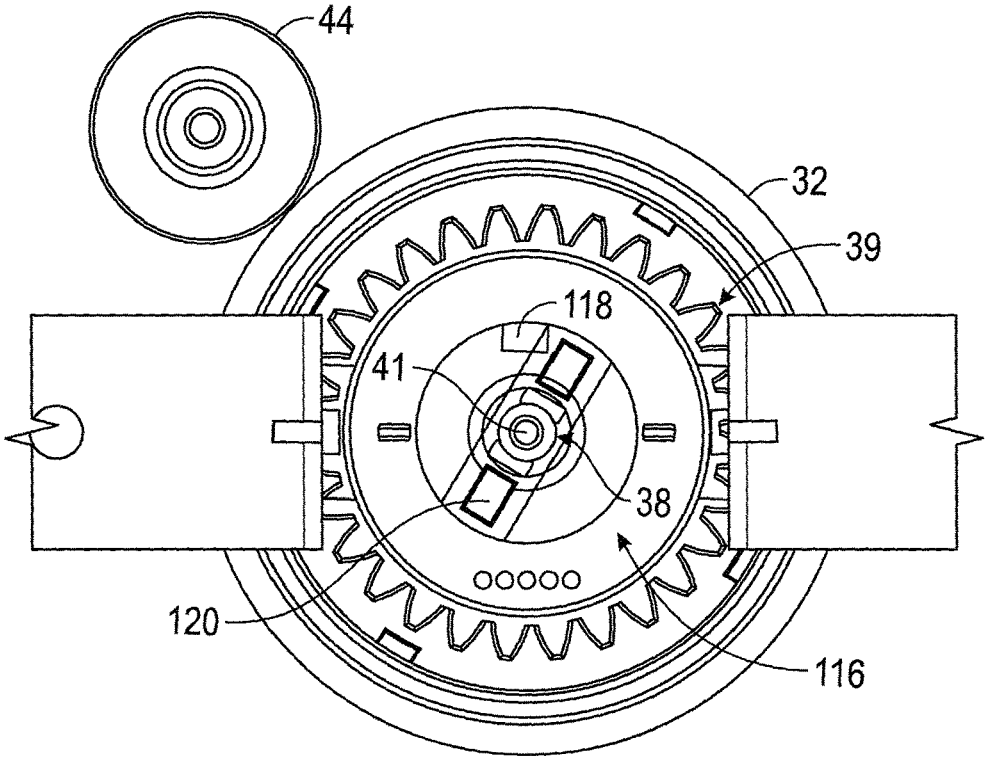
FIG. 4 shows a schematic view of a drive mechanism and a sensor assembly for determining rotations of a feed roller drive system according to one aspect of the present disclosure.

To determine the number of rotations of the motor 40, i.e., in arrangements where the motor can rotate with the feed roller, or to monitor and detect the number of rotations of the drive shaft 41 of the motor, as generally indicated in FIG. 4, the monitoring system 100 further can include at least one sensor assembly 116 that is located/positioned to continuously monitor rotations of the motor. The sensor assembly 116 can be in communication with, e.g., wired or wirelessly, and send a signal indicative of the number of motor rotations to the dispenser controller 110. For example, the sensing assembly 116 can include at least one sensor 118, for example, a reed switch, a hall element, or other suitable sensing mechanism operable to measure or detect variations in magnetic field. As indicated in FIG. 4, the sensor assembly 116 can be located adjacent the drive shaft 41 and further can include at least one magnet 120 arranged along the drive shaft 41 of the motor, with the sensor 118 being arranged or positioned on or adjacent the motor 40 substantially adjacent the drive shaft 41, such that the at least one sensor 118 can detect the presence of and/or fluctuations or variations in magnetic field as the at least one magnet 120 rotates or moves past the sensor 118 with the rotation of the drive shaft 41. A similar sensor assembly can be additionally arranged about the feed roller 32, to determine the movement, number of rotations, or rotation angle thereof. Based on the number of rotations of the motor or the feed roller, as detected/determined by the sensor assembly, a substantially precise length of sheet material dispensed can be monitored and detected/determined.

The dispenser controller 110 receives the information from the monitoring system 100 as to both the number of rotations of a supply of sheet material and the number of rotations of the feed roller 32, and/or its drive motor 40, detected during each dispensing cycle of operation. Typically, the feed roller 32 and its motor 40 can be operated for a predetermined number of rotations to feed the desired, predetermined or pre-selected length/amount of the sheet material (e.g., 8", 10", 12", etc . . . ). When the feed roller 32 or motor 40 has completed such a predetermined number of rotations, the controller 110 can then use the reported/monitored rotations of the supply of sheet material, compared with prior measurements of the supply, to determine a current or updated diameter of the supply of sheet material. This calculated, substantially dynamically updated diameter further will be compared to a base value (e.g., the diameter of a full roll or an empty/near empty roll) to determine a remaining amount of sheet material. If this calculated remaining amount of sheet material is below a threshold amount, a notification can be provided to signal a need for a replacement change of the supply.

By way of illustration, depending upon the predetermined or preset length of sheet material that is desired or generally selected to be fed during a dispensing operation, a number of motor rotations and/or rotations of the feed roller can be generally correlated or known. For example, based upon size of the feed roller and gearing of the motor with respect to the feed roller, and/or historical operation data, an amount of paper dispensed per motor rotation can be known or otherwise determined. Based upon such a known or calculated value of paper dispensed per motor rotation, and the detected or measured number of motor rotations required to complete one paper roll rotation, the diameter of the paper or sheet material supply roll can determined following a dispensing operation. For example, for a known length of sheet material dispensed per motor rotation (mr) of approximately 0.409 cm, the diameter (D) of the supply roll can be determined based upon the following formula:

$$D=0.409\text{ cm}*\text{mr(motor rotations)}/\pi\times 2.4\text{ cm}$$

$$\text{Simplified:}D=\text{mr}/19.5.$$

Alternatively, where the feed roller rotation is being measured or monitored, and a number of motor rotations (mr) per rotation of the feed roller is known, such as based upon gearing, etc., the diameter (D) of the sheet material supply roll can be calculated as follows:

$$D\pi=44\times\pi\times\text{mr(motor rotations)}/34$$

$$\text{Simplified:}D=1.294\times\text{mr}.$$

Accordingly, the remaining diameter or supply of the sheet material can be dynamically calculated, e.g., after a selected number of dispensing cycles or operations, or after substantially each dispensing cycle or operation. This dynamically determined diameter or remaining amount of the supply of sheet material thereafter can be compared to a threshold value or a base value, such as a full or empty/near empty roll diameter, to determine a remaining amount of the supply of sheet material and/or if a low paper notification or signal should be provided such as via display or sent to maintenance personnel by the controller.

Figure 6A:
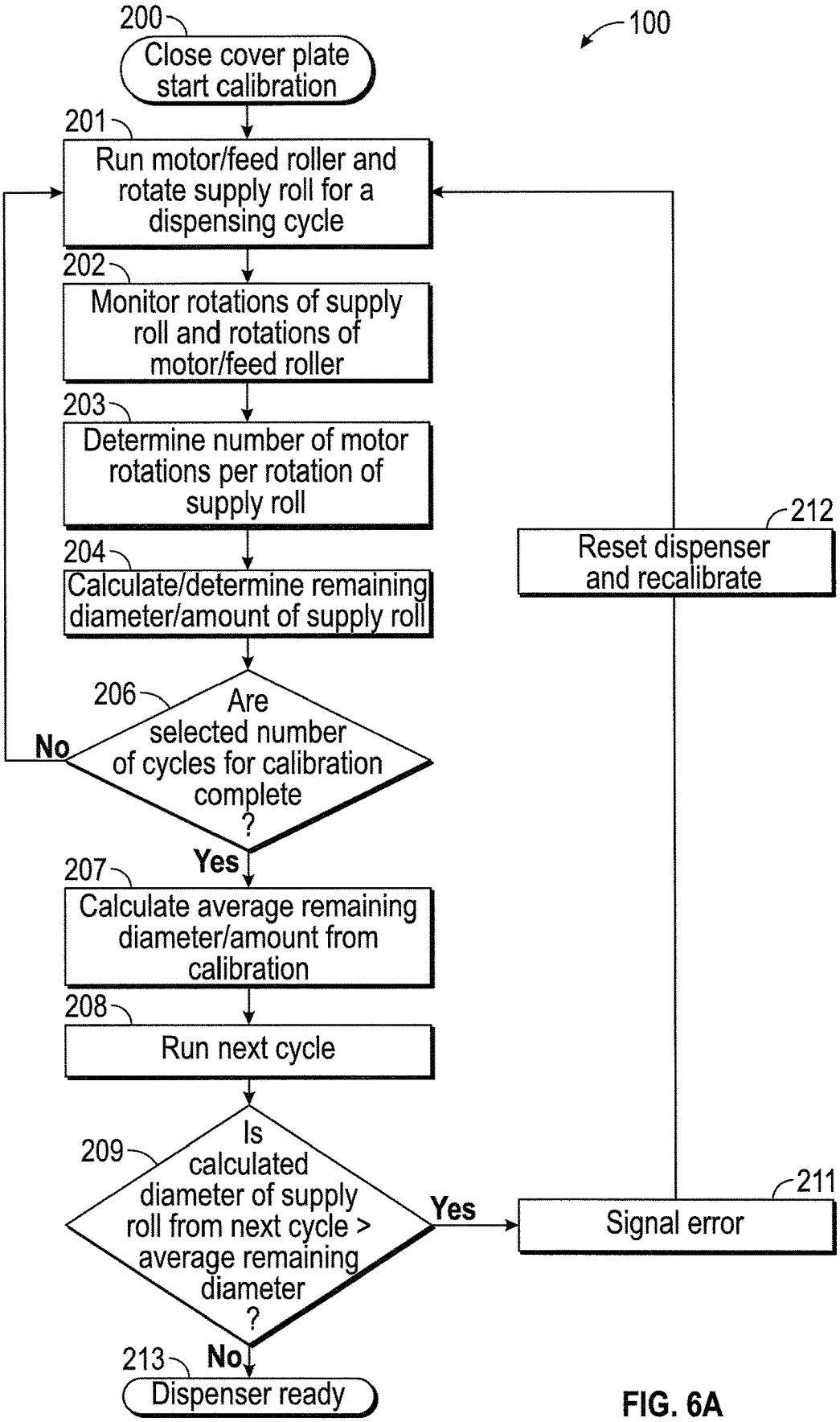
FIG. 6A is a flow diagram illustrating operation of the material supply monitoring and/or measurement system in a calibration mode.
Figure 6B:
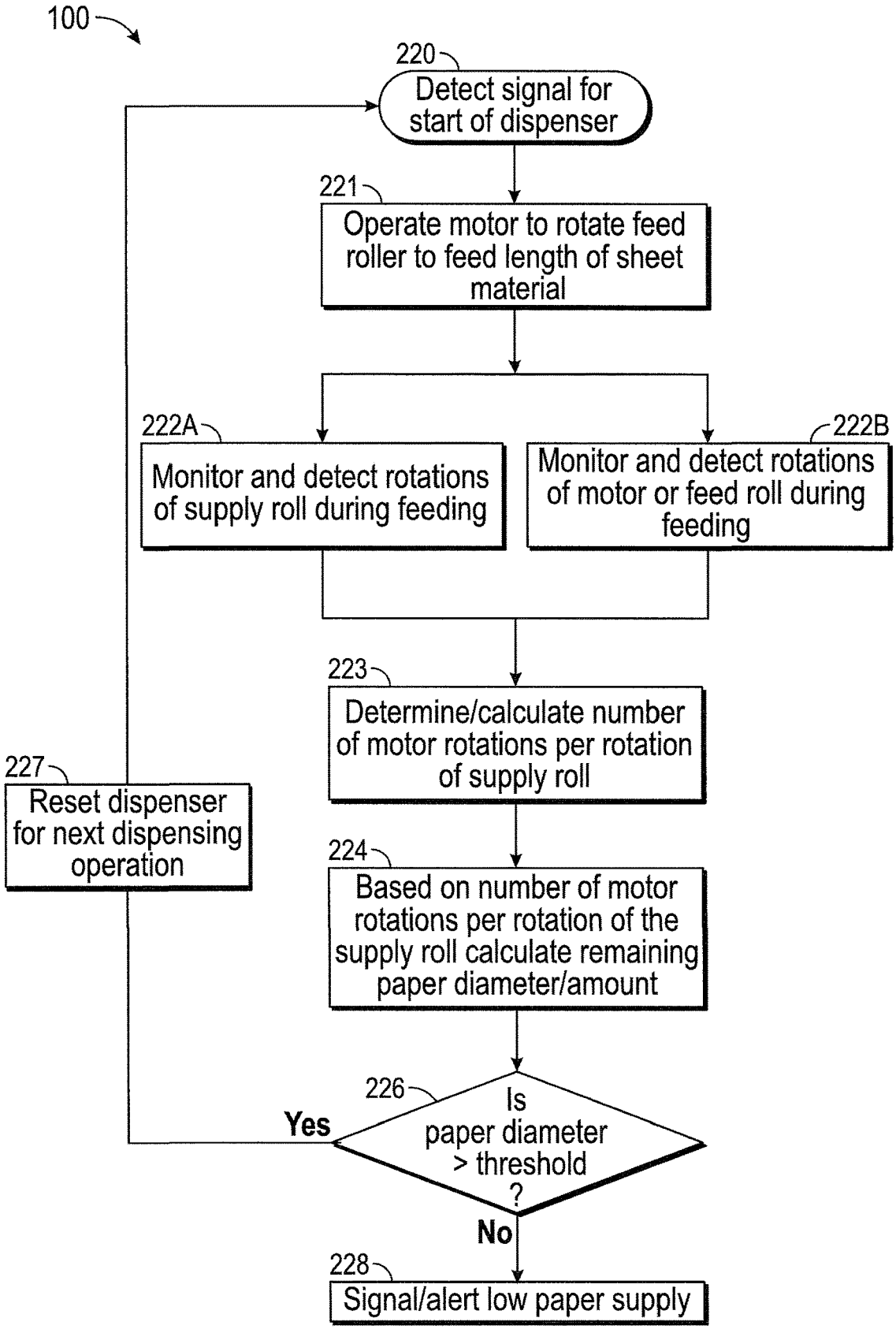
FIG. 6B is a flow diagram illustrating operation of the material supply monitoring and/or measurement system during operation of the dispenser.

In one example embodiment or aspect of the operation of the monitoring system 100 for measuring and monitoring the supply of sheet material being dispensed by the dispenser 10, as indicated in FIGS. 6A and 6B, the dispenser can be operated for a calibration cycle or start-up operation (FIG. 6A). For example, after a roll or supply of paper material has been loaded into the dispenser, upon closing of the cover and/or engagement of a control switch for the dispenser (Step 200), the dispenser can be operated to engage and run the feed roller for at least an initial cycle (Step 201). As indicated at Step 202, the motor and/or feed roller rotations will be monitored as will the rotations of the supply of sheet material during the dispensing cycle. Based on this information, as indicated at Step 203, a number of motor and/or feed roller rotations for each rotation of the supply roll of the sheet material is calculated or determined; and based upon this calculated or determined value, the remaining diameter of the sheet material supply roll can be determined or calculated (Step 204). As indicated at Step 206, this process is repeated for a selected number of initial dispensing cycles (e.g., 5-10 cycles, although greater or fewer cycles also can be used).

After the desired or selected number of initial dispensing cycles has been completed, an average remaining diameter is calculated (Step 207). A next cycle/operation of the dispenser is then run (Step 208), and the calculated remaining diameter of the sheet material supply roll is compared to the average remaining diameter derived from the calibration cycles (Step 209). If this next remaining diameter value is greater than the average remaining diameter value developed by the calibration cycles, the system can generate an error signal (Step 211) and thereafter can alert maintenance staff to check the dispenser, and can reset and rerun the calibration operation (at least for an abbreviated number of cycles) (Step 212). If the next calculated diameter of the sheet material supply is not greater than the average remaining diameter developed by the calibration cycles, the dispenser can be signaled as ready for operation (at Step 213).

Thereafter, as generally illustrated in FIG. 6B, the monitoring system 100 will be operable during at least selected dispensing operations to calculate a remaining amount or diameter of the sheet material supply within the dispenser. As indicated at Step 220, the operation of the dispenser generally will start in response to the controller receiving a signal from a hand sensor or other detector 130 (FIG. 5), which can indicate the presence of a user (e.g., their hand), or alternatively, the engagement and/or pulling of a hanging sheet of the sheet material can initiate a dispensing operation. In response, the feed motor for the feed roller is engaged and operated to feed a selected length of the sheet material (Step 221). As the feed roller is operated to feed the selected length of sheet material, the supply of sheet material generally is rotated.

The rotation of the supply of sheet material is monitored to detect the number of rotations thereof for feeding the selected length of material (Step 222A), while the motor and/or feed roller also are monitored (Step 222B). Based on this information, the system will determine the number of rotations of the motor per substantially complete rotation of the supply roll (Step 223). Using the determined or calculated number of motor rotations per rotation of the supply roll and number of motor/feed roller rotations detected, a remaining paper diameter of the supply roll is calculated, at Step 224.

This calculated remaining paper diameter is then compared to a threshold value at Step 226 (and/or to values of a full and a deleted roll to calculate a remaining paper/supply percentage). If the calculated paper diameter is greater than the threshold value, the dispenser can be reset for a next dispensing operation, as indicated at Step 227. If the calculated paper diameter is less than a selected or determined threshold value, as indicated at Step 228, a signal or alert of a low paper supply can be generated and provided either via the display 136 (FIG. 5) connected to the controller 110 of the dispenser, or can be otherwise transmitted or sent to maintenance staff, such as an antenna or wireless connection 146.

In addition, while the number of rotations of the feed roller preferably can be set to feed a known amount of sheet material to be dispensed for each cycle, the rotations of the feed roller 32 and/or the motor 40 still generally can be monitored to determine the amount of sheet material fed. For example, during a manual operation, or if the operation of the dispenser is interfered with, a full length of sheet material may not be fed. Thus, the monitoring system can actively monitor the amount of sheet material fed per each cycle to provide a running total or substantially dynamically determined amount of remaining sheet material with as much precision or accuracy as possible during each operation of the dispenser 10.

The controller 110 further may be in communication with a notification system operable to indicate the remaining amount of sheet material in the dispenser determined by the controller. For example, the notification system can include a display, such as an LED or LCD display 136 (FIG. 5), arranged along an external portion of the housing operable to numerically or graphically indicate the amount of sheet material remaining. Alternatively, the notification system can include a series of lights, such as LED lights, arranged on the housing that activate or deactivate based on the remaining amount of sheet material determined by the controller. In addition, or in the alternative, the controller can be configured to communicate with a computer, server, or mobile device, e.g., a tablet, smartphone, watch or other smart device. For example, the controller 110 can include, or otherwise be in communication with, an antenna, such as a Bluetooth, RF, or WiFi antenna, such that signals indicative of the remaining amount of sheet material can be communicated to the computer, sensor, or mobile device, to facilitate continuous, remote monitoring of the remaining amount of sheet material.

The controller 110 also can include a memory 111 that can store historical data for a predetermined time period. For example, the recorded measurements of the supply of sheet material over the past hour, two hours, day, etc. . . . , can be stored and used by the controller (or a computer or server linked to the controller) to develop a projected end of supply based on historical uses/trends. This projected end of supply can be communicated to maintenance staff, such as wirelessly from the controller or through the display of the dispenser (e.g., displaying a remaining percentage or projected run-out of the supply), to allow them to prioritize servicing of the dispenser (i.e., immediate attention is required or replacement may not be needed for several hours or until the next day.)

Figure 7:
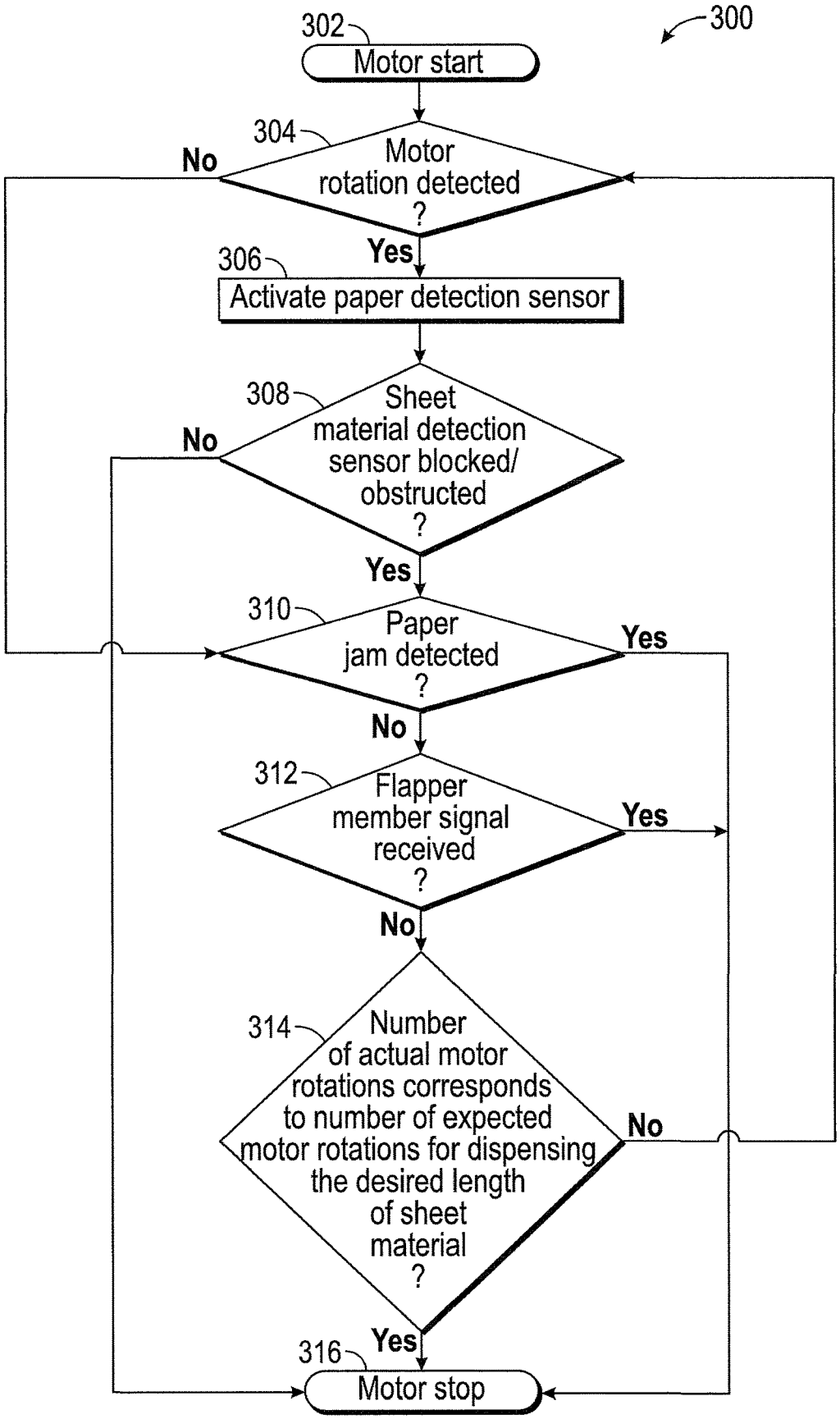
FIG. 7 is a flow diagram illustrating operation of the dispenser in various modes.

FIG. 7 shows a flow diagram illustrating an exemplary process 300 of operation of the dispenser in various modes, e.g., in an automatic feeding mode. As shown in FIG. 7, at Step 302, the motor 40 can start or otherwise be activated, for example, upon detection of a user's hand or an object by the proximity sensor 33, or by activation of the flapper member 70, such as due to a user pulling a hanging tail or paper length, etc.

Upon starting a dispensing cycle or operation the controller 110 can determine whether the monitoring system 100 has detected rotation of the motor 40 (at Step 304). If motor rotation is signal is provided by the monitoring system, the controller 110 can activate the sheet material detection sensor 80, to cause the emitter of the sheet material detection sensor to emit at least one pulse (Step 306). Additional pulses can be sent after each motor rotation is detected by the measurement system. Thus, the operation of the sheet material detection sensor generally will be tied to the actual detected rotations of the motor (i.e., the motor driveshaft), with the number of pulses and timing thereof varying during each dispensing operation.

Thereafter, at Step 308, when a pulse is sent, a determination can be made as to whether the sheet material detection sensor 80 is obstructed or blocked by the sheet material. If the sensor 80 is not blocked or obstructed, rotation of the motor 40 can be stopped or otherwise deactivated (Step 318) because, for example, the sheet material has already been removed by a user.

If the sheet material detection sensor 80 is blocked or obstructed, however, a determination can be made as to whether a paper jam has been detected at Step 310. If a paper jam is detected, the motor 40 can be stopped or otherwise deactivated. If a paper jam is not detected, the controller 110 can determine whether a stop signal has been received from the flapper member 70 (at Step 312), e.g., if the flapper member 70 has been moved to its second position 74 due to engagement with the sheet material, such as for tearing or separating the sheet material.

If a stop signal has been received from the flapper member 70, the motor 40 can be stopped or deactivated (at Step 318). If a stop signal is not received from the flapper member 70, a determination can be made by the controller 110 as to whether the number of actual rotations of the motor detected by the measurement system corresponds to the number of expected motor rotations for dispensing the desired length of sheet material (at Step 314).

Accordingly, if sheet material is signaled as missing or torn, e.g., based upon activation of the flapper member 70 or detection of the paper being missing in the discharge chute by the sheet material sensor 80, before the motor completes the corresponding number of revolutions to feed a prescribed length of sheet material, this might be indicative of an early tear by a user and the motor can be stopped, for example, to avoid sheet material extending from the discharge chute (e.g., a tail) if not wanted or to avoid or otherwise prevent a paper jam.

If, at Step 314, it is determined that the motor 40 has completed the corresponding number of revolutions for feeding the prescribed length of sheet material, the motor 40 may be stopped or otherwise deactivated. However, if not, the process can return to step 304 to continue to detect further motor rotations. If no motor rotations are detected, the process 300 may continue again to Steps 310 through 314.

Any of Steps 302 to 316 can be arranged in any suitable sequence or can be omitted entirely, without departing from the scope of the present disclosure. Also, additional steps can be included, without departing from the scope of the present disclosure. For example, upon stoppage of the motor, the sheet material detection sensor can be activated or pulsed to verify that the discharge chute is clear of sheet material and to reset the dispenser for subsequent operations.

Activating, e.g., pulsing, the sheet material detection sensor to correspond to the rotations of the motor can substantially improve the efficiency of the dispenser. For example, some dispensers may pulse a sheet material detection sensor continuously during running of the motor, and, as a result, often will have longer pulsing intervals with more pulses typically being generated as the motor runs slower, and thus the dispensing time becomes longer, due to a lower power condition. With embodiments of the present disclosure, however, since the sheet material detection sensor pulses with each detected motor rotation, the sheet material detection sensor generally will be activated/pulsed the same number of times during each dispensing operation independently of motor speed (e.g., during low power conditions), preserving power.

The foregoing description generally illustrates and describes various embodiments of this disclosure. It will, however, be understood by those skilled in the art that various changes and modifications can be made to the above-discussed constructions and systems without departing from the spirit and scope of this disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of this disclosure. Accordingly, various features and characteristics as discussed herein may be selectively interchanged and applied to other illustrated and non-illustrated embodiment, and numerous variations, modifications, and additions further can be made thereto without departing from the spirit and scope of the present invention as set forth in the appended claims.

What is claimed is:

1. A dispenser for dispensing a sheet material, comprising:

a roll support for supporting a supply of the sheet material;

a feed roller arranged along a feed path of the sheet material downstream from the supply of sheet material, the feed roller engaging and pulling the sheet material from the supply of sheet material for feeding along a dispensing path upon the rotation of the feed roller;

a controller in communication with the feed roller and including programming for monitoring rotation of the feed roller during a dispensing cycle for feeding a selected length of the sheet material from the supply of sheet material; and a material supply monitoring system in communication with the controller operable to detect a number of rotations or an angle of rotation of the supply sheet material during at least a series of dispensing cycles, and based upon changes in such signals, a remaining diameter of the supply of sheet material is substantially dynamically determined after at least each of the series of dispensing cycles, the material supply monitoring system including:

at least one magnet configured to be operatively connected to the supply of sheet material so as to be rotatable therewith; and at least one sensor mounted on the roll support and located adjacent the supply of sheet material in a position to detect variations or changes in a magnetic field generated as the at least one magnet passes the at least one sensor when the supply of sheet material is rotated.

2. The dispenser of claim 1, further comprising at least one pressing roller arranged along the feed path and rotatable with the feed roller such that the sheet material is engaged and pulled between the at least one pressing roller upon rotation of the feed roller.

3. The dispenser of claim 1, further comprising a pair of spaced pressing rollers adjacent and in driven contact with the feed roller so as to rotate with rotation of the feed roller, and wherein the sheet material is engaged and pulled between the pressing rollers and feed roller upon rotation thereof.

4. The dispenser of claim 1, wherein the at least one sensor comprises a switch, hall element, or proximity sensor.

5. The dispenser of claim 1, further comprising a drive motor coupled to the feed roller and in communication with the controller, which controls operation of the drive motor to drive the rotation of the feed roller for feeding the selected length of sheet material.

6. The dispenser of claim 5, further comprising one or more sensors operable to detect the presence of an object, and upon detection of the object, activating the drive motor for feeding the selected length of sheet material.

7. The dispenser of claim 1, further comprising a sheet material detection sensor arranged along the feed path of the sheet material and configured to detect removal of the selected length of sheet material.

8. The dispenser of claim 7, wherein the sheet material detection sensor is activated upon a detected rotation of the supply sheet material.

9. The dispenser of claim 1, further comprising a plurality of supplies of sheet material, wherein the material supply monitoring system is operable to detect rotations or an angle of rotation of each of the plurality of supplies of sheet material.

10. The dispenser of claim 1, wherein the material supply monitoring system is operable to verify that one or more of the plurality of supplies of sheet material has been loaded into the dispenser.

11. A method of operating a paper dispenser, comprising:

rotating a feed roller to feed a length of paper from a supply roll;

detecting a number of rotations of the supply roll for feeding the length of paper using a material supply monitoring system, the material supply monitoring system including at least one magnet configured to be operatively connected to the supply roll so as to be rotatable therewith; and at least one sensor mounted on a roll support that supports the supply roll and located adjacent the supply roll in a position to detect variations or changes in a magnetic field generated as the at least one magnet passes the at least one sensor when the supply roll is rotated;

determining a number of rotations of a motor driving the rotation of the feed roller per rotation of the supply roll during feeding of the length of paper; and determining a remaining paper diameter of the supply roll based upon the number of rotations of the motor per rotation of the supply roll and an amount of paper dispensed per rotation of the motor.

12. The method of claim 11, wherein rotating the feed roller comprises operating the motor to drive the feed roller for a number of rotations sufficient to feed a selected length of paper or until a stop signal is received by a controller of the dispenser.

13. The method of claim 11, further comprising comparing the remaining paper diameter to a threshold value and directing a low paper condition if the threshold value exceeds the remaining paper diameter.

14. The method of claim 11, further comprising activating the motor to drive the feed roller for feeding the length of paper upon detection of an object with one or more sensors.

* * * * *